US010765162B2

(12) United States Patent
Mao

(10) Patent No.: US 10,765,162 B2
(45) Date of Patent: Sep. 8, 2020

(54) CAP AND METHOD OF MANUFACTURING A CAP

(71) Applicant: Shanghai Pacific Hat Manufacturing Company, LTD, Shanghai (CN)

(72) Inventor: Zhen Mao, Shanghai (CN)

(73) Assignee: Shanghai Pacific Hat Manufacturing Co., LTD, Shanghai (CN)

( * ) Notice: Subject to any disclaimer, the term of this patent is extended or adjusted under 35 U.S.C. 154(b) by 0 days.

(21) Appl. No.: 16/270,868

(22) Filed: Feb. 8, 2019

(65) Prior Publication Data

US 2019/0166941 A1 Jun. 6, 2019

Related U.S. Application Data

(63) Continuation of application No. 16/316,400, filed as application No. PCT/CN2016/089914 on Jul. 13, 2016.

(51) Int. Cl.

| | |
|---|---|
| ***A42C 1/04*** | (2006.01) |
| ***A42B 1/22*** | (2006.01) |
| ***A42B 1/06*** | (2006.01) |
| ***A42C 1/02*** | (2006.01) |
| ***A42B 1/02*** | (2006.01) |
| ***A42B 1/20*** | (2006.01) |

(Continued)

(52) U.S. Cl.

CPC ..... *A42B 1/22* (2013.01); *A42B 1/02* (2013.01); *A42B 1/062* (2013.01); *A42B 1/208* (2013.01); *A42C 1/02* (2013.01); *A42C 1/04* (2013.01); *A42C 1/06* (2013.01); *A42C 1/08* (2013.01)

(58) Field of Classification Search

CPC .. A42B 1/22; A42B 1/02; A42B 1/062; A42B 1/208; A42C 1/02; A42C 1/04; A42C 1/06; A42C 1/08; A42C 1/00

See application file for complete search history.

(56) References Cited

U.S. PATENT DOCUMENTS

| | | | |
|---|---|---|---|
| 1,614,231 | A | 1/1927 | Crosgrove |
| 1,808,681 | A | 6/1931 | Rayburn |

(Continued)

FOREIGN PATENT DOCUMENTS

| | | | |
|---|---|---|---|
| CN | 1526336 | A | 9/2004 |
| CN | 201612191 | U | 10/2010 |

(Continued)

OTHER PUBLICATIONS

Baseball Cap, Feb. 5, 2006 (accessed Jul. 17, 2019), How Products are Made, http://www.madehow.com/Volume-4/Baseball-Cap.html (Year: 2006).*

(Continued)

*Primary Examiner* — Matthew J Daniels
*Assistant Examiner* — Andrew L Swanson
(74) *Attorney, Agent, or Firm* — Locke Lord LLP

(57) ABSTRACT

A baseball cap and method of assembling thereof is provided. The cap includes a single-panel crown that is formed from a single sheet or single piece of stretchable fabric, such as using heat pressing techniques. The single-panel crown has a hemispherical shape. The cap further includes a support layer, such as made from buckram, which is attached to an interior, front portion of the single-panel crown, and a visor and an elastic band which are attached to the single-panel crown.

10 Claims, 5 Drawing Sheets

(51) Int. Cl.
*A42C 1/06* (2006.01)
*A42C 1/08* (2006.01)

(56) References Cited

U.S. PATENT DOCUMENTS

| | | | | |
|---|---|---|---|---|
| 2,343,155 | A | 2/1944 | Paul | |
| 3,041,628 | A | 7/1962 | Fish et al. | |
| 4,790,034 | A | 12/1988 | Pass | |
| 5,099,524 | A | 3/1992 | Linday | |
| 5,247,709 | A | 9/1993 | Epply | |
| 5,724,675 | A | 3/1998 | Lipkin et al. | |
| 6,363,537 | B1 | 4/2002 | Park | |
| 6,446,266 | B1 | 9/2002 | Park | |
| 6,484,323 | B1 | 11/2002 | Pu | |
| 6,493,880 | B1 * | 12/2002 | Lo | A42B 1/062 2/195.2 |
| 7,036,156 | B2 | 5/2006 | Lahman et al. | |
| 10,314,358 | B1 | 6/2019 | Mao | |
| 2003/0024033 | A1 * | 2/2003 | Viggiano | A42B 1/247 2/209.13 |
| 2005/0223474 | A1 | 10/2005 | Cho | |
| 2007/0056078 | A1 | 3/2007 | Tseng | |
| 2007/0130669 | A1 | 6/2007 | Rogers | |
| 2010/0205715 | A1 | 8/2010 | Dillavou | |
| 2016/0021961 | A1 * | 1/2016 | Lacy | A42B 1/22 2/195.4 |
| 2017/0129200 | A1 * | 5/2017 | Adami | B29C 35/0805 |
| 2018/0116325 | A1 | 5/2018 | Woods | |

FOREIGN PATENT DOCUMENTS

| | | | | |
|---|---|---|---|---|
| CN | 102742957 | A | 10/2012 | |
| DE | 102014100220 | A1 | 6/2015 | |
| IT | UB20155474 | A1 | 11/2017 | |
| JP | H06051237 | U | 7/1994 | |
| JP | U0003068282 | U | 4/2000 | |
| JP | 20033316 | A | 1/2003 | |
| JP | U0003164520 | U | 12/2010 | |
| JP | 3187344 | B2 | 11/2013 | |
| JP | 2015518928 | A | 7/2015 | |
| KR | 20150004276 | U | 11/2015 | |
| WO | WO 0036941 | A1 | 6/2000 | |
| WO | WO 2004054397 | A1 | 7/2004 | |
| WO | WO-2010010199 | A2 * | 1/2010 | A42B 1/248 |

OTHER PUBLICATIONS

Cap Wholesalers, Jun. 27, 2014 (accessed Jul. 17, 2019), Cap Wholesalers, https://www.capwholesalers.com/page_63350_220/yupoong-brand-flat-bill-210-fitted-pro-baseball-on (Year: 2014).*

Canadian Office Action for Canadian Patent Application No. 3,030,457 dated Mar. 1, 2019.

International Search Report and Written Opinion for International Application No. PCT/CN2016/089914 dated Apr. 19, 2017.

Extended European Search Report for Application No. 16908452.2-1017/3484319 dated Mar. 4, 2020.

* cited by examiner

CAP AND METHOD OF MANUFACTURING A CAP

CROSS-REFERENCE TO RELATED PATENT APPLICATIONS

This application for patent is a continuation of U.S. application Ser. No. 16/316,400, filed Jan. 9, 2019, which is a 371 of International Application No. PCT/CN2016/089914, filed Jul. 13, 2016, of which all of the applications are incorporated by reference herein in their entirety

FIELD

The present disclosure is related to a method of assembling or manufacturing headwear such as a cap, and more particularly, to a cap assembly that incorporates a single-panel crown formed of stretchable fabric.

BACKGROUND

Headwear can include various components, such as a crown and a visor (e.g., bill). One type of headwear is a hat, such as a cap or a baseball cap, in which the crown is traditionally formed of six (6) crown panels or 5/4/3/2 crown panels because the fabric is flat, unless the crown is specially hand-crocheted with yarn. However, the multiple crown panels are connected together using conventional attachment techniques, such as stitching or sewing. Such conventional manufacturing techniques increase the time, complexity and cost of assembling or manufacturing components of a cap together. These types of conventional caps also are restrictive in terms of head size ranges, and thus, must be made in many different sizes to accommodate different wearers. Furthermore, the materials used for the flat crown panels in these caps are susceptible to wrinkling, particularly those which use heavier fabrics.

SUMMARY

A cap and method of assembling thereof is provided, which employ a single-panel crown formed of a stretchable fabric. The method of assembling a cap, such as for example a baseball cap, involves forming a single-panel crown for a cap from a single sheet or single piece of stretchable fabric, attaching a support layer to an interior, front portion of the single-panel crown with an adhesive, and attaching a visor and an elastic band to the single-panel crown with the attached support layer. The single-panel crown can be formed by heating and stretching the single sheet or single piece of stretchable fabric to form a hemispherical shape on a portion of the stretchable fabric, and cutting any extra edge portion or portions of the stretchable fabric that extend from or beyond the hemispherical shaped portion in order to form the single-panel crown for the cap. Heat can be applied to one or both sides of the stretchable fabric, and as heat is applied, a pressing force can be applied to the stretchable fabric using a hemispherical shaped fabric mold to stretch the portion of the stretchable fabric into the hemispherical shape. The stretchable fabric can be made of a woven or non-woven material, and can be an elastic fabric (or fabric with elastic properties) that includes 2% to 5% spandex, preferably around 3% of spandex.

The support layer can be made of buckram. To attach the support layer to the single-panel crown, a coat of an adhesive can be applied to a surface of the buckram or an interior, front portion of the single-panel crown. The buckram can then be pressed (e.g., heat pressed) against the interior, front portion of the single-panel crown so that the adhesive bonds the buckram to the interior, front portion of the single-panel crown. Furthermore, bonding tape can be applied over one or more seams that are formed between an edge of the buckram and an interior surface of the single-panel crown. Each of the one or more seams extends radially from an interior, central portion to a bottom edge of the single-panel crown, and the bonding tape covers the one or more seams and further connects the buckram to the single-panel crown.

The cap with a single-panel crown is designed to provide numerous benefits over conventional caps. For example, the single-panel crown can be formed from a stretchable fabric in a manner that requires substantially less labor in comparison to conventional crowns such as those formed by connecting multiple flat crown panels or by hand crocheting yarn. Thus, with a single-panel crown design as described herein, it is possible to assemble or manufacture a cap (e.g., a baseball cap) in a more efficient, faster and less costly manner in comparison to conventional caps. Furthermore, a cap with such a single-panel crown is able to cover a larger range of head sizes, has increased or improved tear strength by eliminating the need for stitching ordinarily employed to connect multiple flat crown panels together in conventional caps, and is less susceptible to wrinkling particularly when employing light or lighter stretchable fabric for the crown.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

Figure 1:
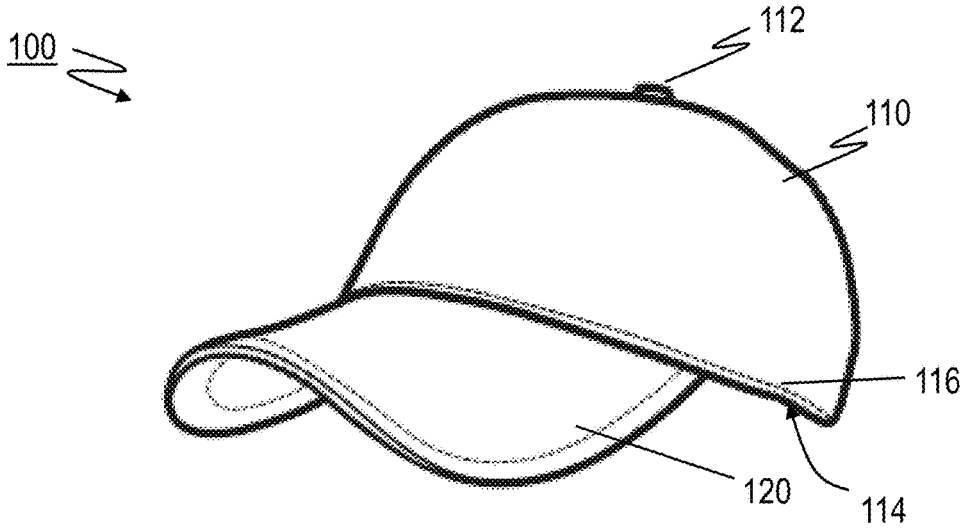
FIG. 1 is a perspective view of an example headwear, such as an example cap that incorporates a single-panel crown formed from a single sheet or single piece of stretchable fabric, in accordance with an exemplary embodiment of the present disclosure.
Figure 2:
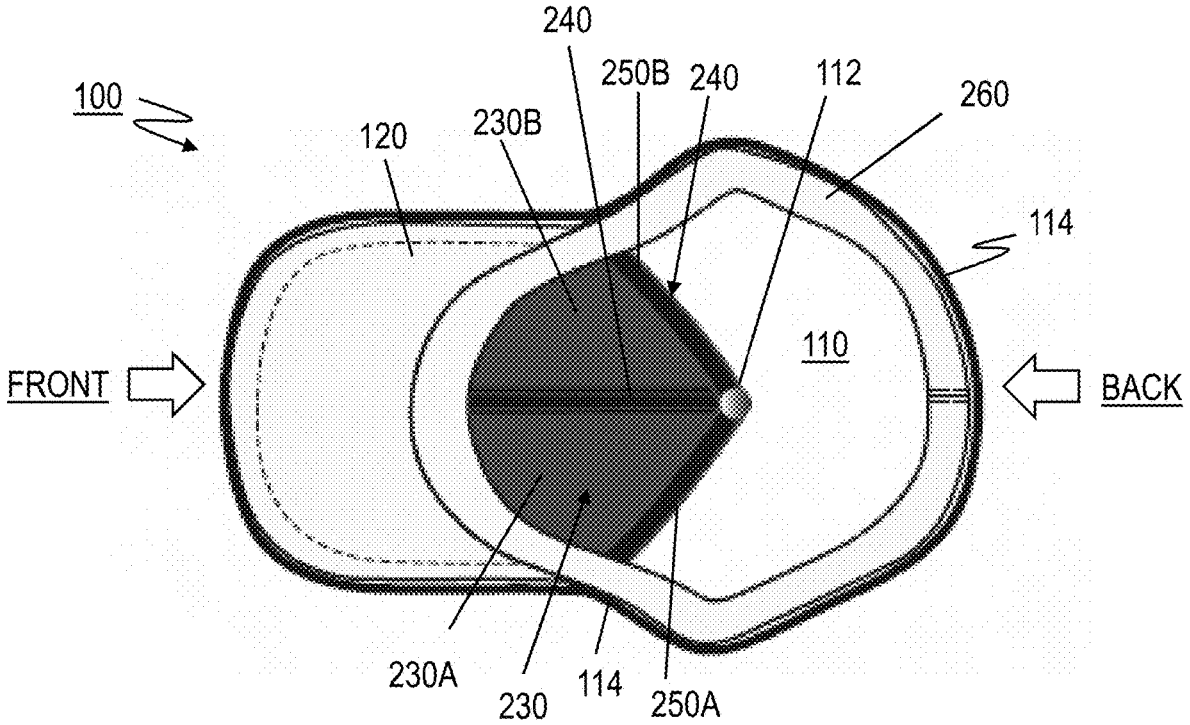
FIG. 2 is a bottom view showing an interior or inside of the single-panel crown of the cap in FIG. 1.

FIGS. 1 and 2 illustrate a headwear, such as a cap 100. As shown in FIG. 1, the cap 100 includes a single-panel crown 110. A top button 112 and a visor 120 are attached (or connected) to the crown 110. The single-panel crown 110 has a hemispherical shape (e.g., a dome shape) and is formed of a stretchable fabric, preferably a light or lighter stretchable fabric. The fabric can be a woven or non-woven material, and can be an elastic fabric that is formed, such as for example with spandex (e.g., between 2% and 5% spandex, preferably around 3% spandex). As will be described in greater detail below, the single-panel crown 110 can be formed by heating and stretching a single sheet or single piece of a stretchable fabric into a hemispherical shape using a heat pressing system or heat press transfer machine with a suitable fabric-shaping mold or fabric mold (e.g., a hemispherical-shaped fabric mold).

As further shown in FIG. 2, the cap 100 also includes a support layer 230, and an elastic band 260. The support layer 230 is attached to an interior or inside of the single-panel crown 110 to provide structural support for a desired portion(s) of the single-panel crown 110 of the cap 100. In this example, the support layer 230 is attached to an interior, front portion of the single-panel crown 110.

The support layer 230 can be formed as a single panel or by connecting multiple support panels. For example, as shown in FIG. 2, the support layer 230 includes two support panels 230A and 230B, which can be connected together along their seam such as, for example, by sewing or stitching, with bonding tape, with an adhesive, or a combination thereof In this example, the two support panels 230A and 230B together with a strip 240 of bonding tape or fabric are stitched and the strip 240 covers the seam between the support panels 230A and 230B. The support layer 230 can be formed of a rigid material, such as buckram.

The support layer 230 can be attached to the interior or inside of the single-panel crown 110 through heat transfer techniques using an adhesive (e.g., a fabric adhesive), as well as using bonding tape. As shown in FIG. 2, two strips 250A and 250B of bonding tape are applied along respective seams between an outer edge or periphery of the support layer 230 and the interior of the single-panel crown 110. The strips 250A and 250B of bonding tape further attach the support layer 230 to the single-panel crown 110, and cover respective seams therebetween that extend radially from a central or center portion to a bottom edge (or rim) 114 of the single-panel crown 110. The bonding tape, as used herein, can be a single-sided or double-sided heat bonding tape or adhesive tape (e.g., a pressure sensitive adhesive tape). An adhesive, as used herein, can be a fabric adhesive that is applied with or without heat to bond two or more components together.

The elastic band 260 is attached around an interior of the bottom edge 114 of the single-panel crown 110 with the attached support layer 230. The elastic band 260 can be a sweatband. The visor 120 and the elastic band 260 can be attached to the single-panel crown 110 by sewing or stitching them to the single-panel crown 110 (see e.g., stitches or stitching 116 in FIG. 1).

Figure 3:
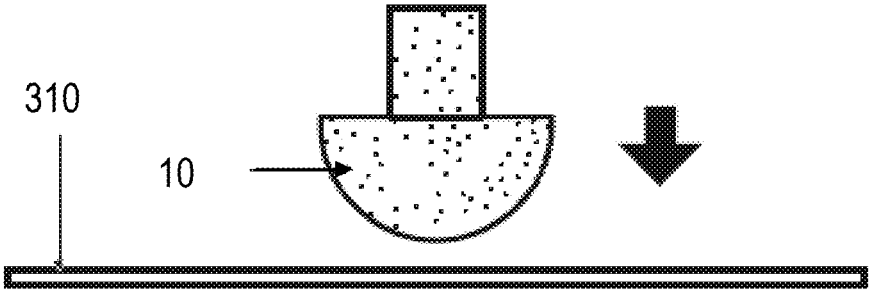
FIGS. 3 through 8 illustrate various operations involved in an exemplary process of assembling or manufacturing a cap such as in FIG. 1.
Figure 4:
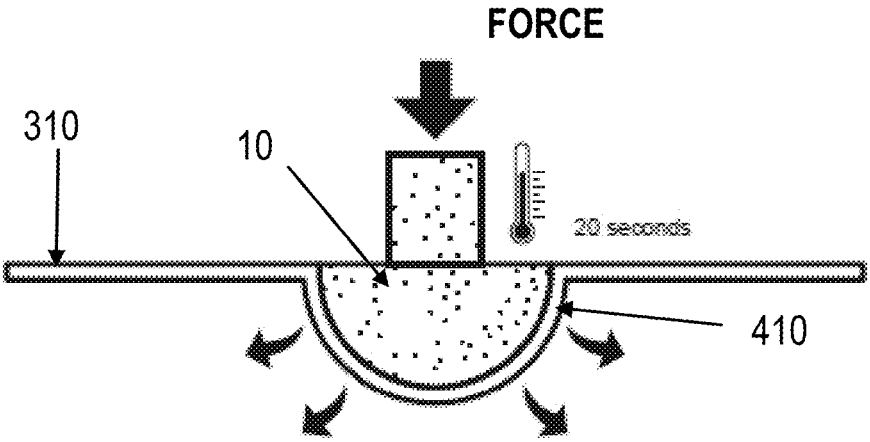

FIGS. 3 through 8 illustrate an exemplary step-by-step process of assembling or manufacturing a cap with a single-panel crown, such as shown in FIG. 1. As shown in FIGS. 3 and 4, a single sheet or single piece of stretchable fabric 310 is provided. The stretchable fabric 310 can be an elastic fabric. A portion of the stretchable fabric 310 is heated and pressed with a sufficient force by a hemispherical-shaped fabric mold 10 (of a heat press transfer machine or heat pressing system) to form a hemispherical shape on the fabric 310, i.e., a hemispherical-shaped portion 410. The amount of force, temperature and time used in the heating and stretching processes can vary according to the properties of the stretchable fabric 310 in the heating and stretching operations. The size and shape of the mold 10 can be changed, as desired, to accommodate different types of caps and head sizes or head size ranges.

Figure 5:
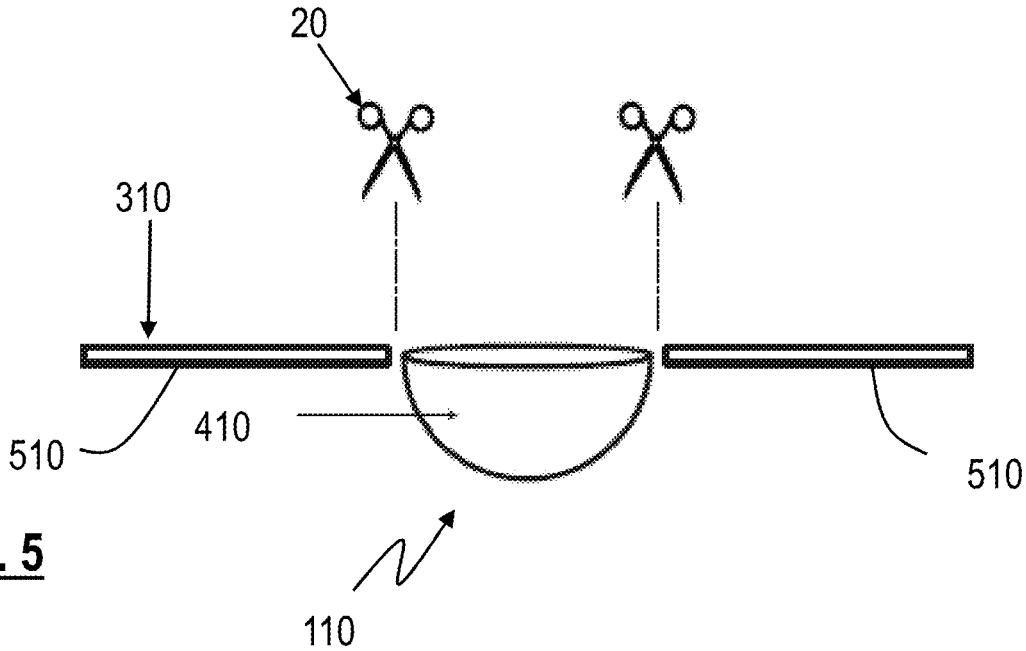

As shown in FIGS. 5, the stretchable fabric 310 is subsequently cut or trimmed, if necessary, to remove any extra edge portion or portions 510 that extend beyond the hemispherical-shaped portion 410. In this way, a single-panel crown 110 is formed from the hemispherical-shaped portion 410 of the stretchable fabric 310. As an alternative, the stretchable fabric 310 can be cut beforehand or pre-cut into a fabric blank (e.g., a circular or oval blank of the stretchable fabric 310) with a suitable size and shape to avoid the necessity of performing a trimming or cutting operation after the heating and stretching processes. For example, the fabric blank can be heated and stretched, as described herein, to form the single-panel crown 110 with a hemispherical shape.

Figure 6:
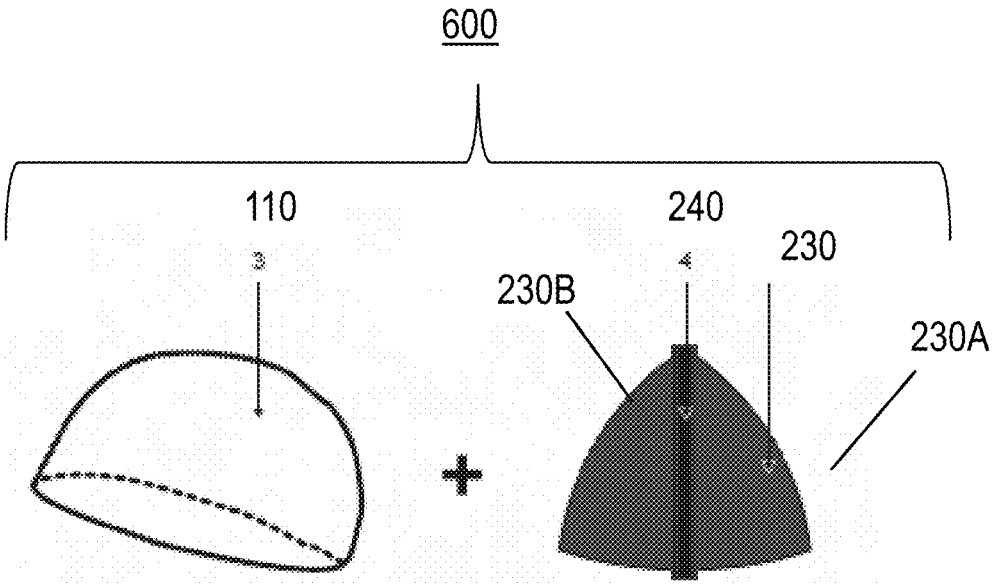

As shown in FIG. 6, a support layer 230 is to be attached to an interior or inside of the single-panel crown 110, which is noted by reference 600. In this example, the support layer 230 is formed of two support panels 230A and 230B (e.g. triangular-shaped panels), which are connected by sewing or stitching along a seam formed by adjacent outer edges of the support panels 230A and 230B. For example, a strip 240 of fabric or bonding tape, which is applied over the seam between the support panels 230A and 230B, is sewed or stitched to attach or to further attach the support panels 230A and 230B along with the strip 240 together. However, the support panels 230A and 230B can be attached in other ways, such as using adhesives (e.g. fabric adhesives), bond taping, etc.

Figure 7:
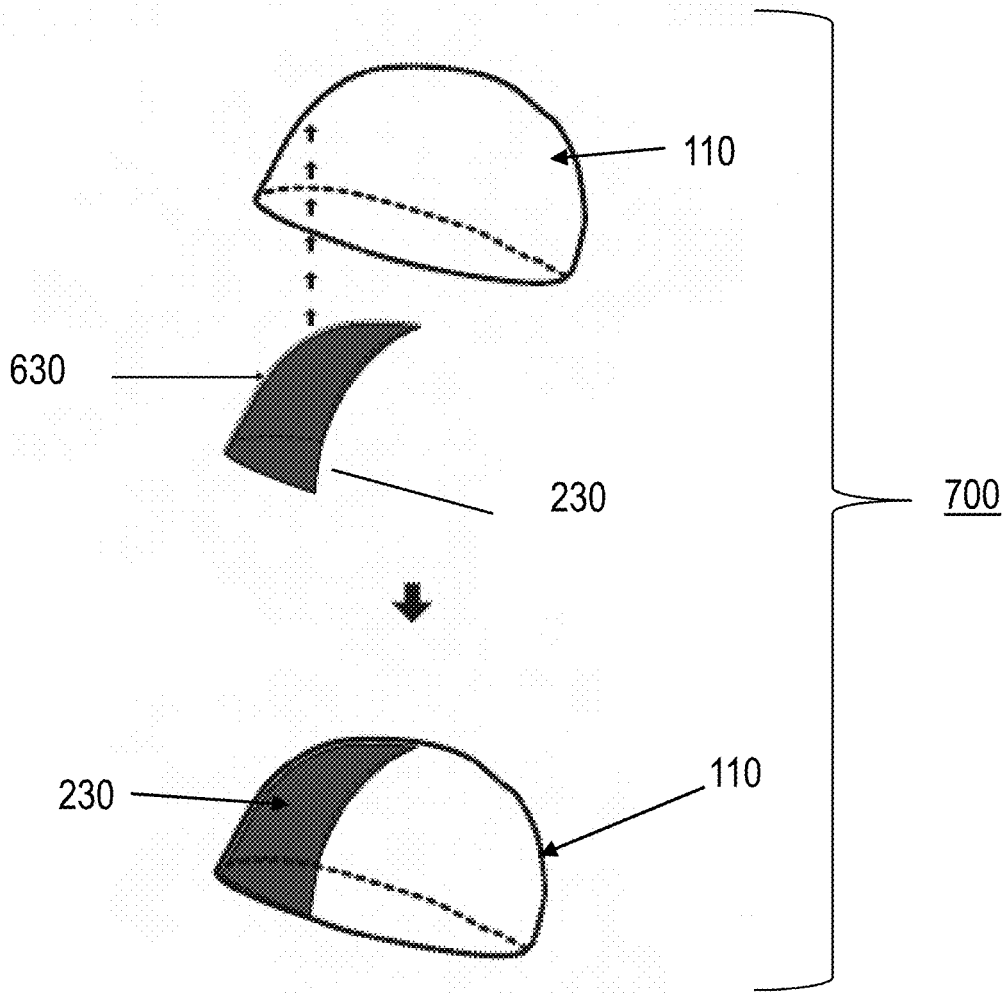
Figure 8:
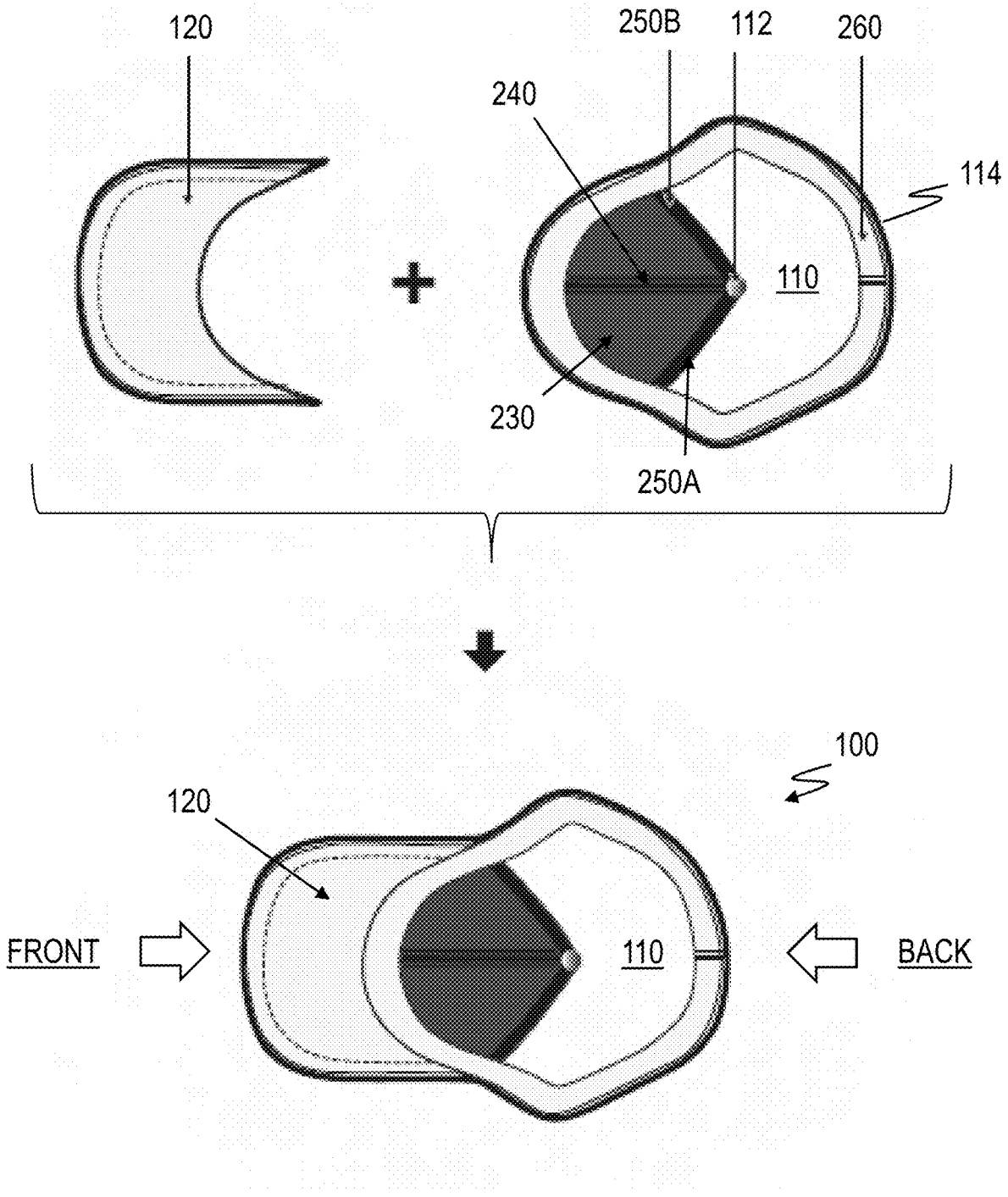

As shown by reference 700 in FIG. 7, the support layer 230 can be attached to the interior or inside of the single-panel crown 110 using an adhesive 630 (e.g., fabric adhesive). For example, a coating of the adhesive 630 is applied on one side or surface of the support layer 230. The support layer 230 is thereafter inserted into the single-panel crown 110, and then pressed against an interior, front portion of the single-panel crown 110 to attach the support layer 230 to the single-panel crown 110. As shown in FIG. 8, two strips 250A and 250B of bonding tape are applied along respective seams between an outer edge or periphery of the support layer 230 and the interior of the single-panel crown 110 (also referred to as "seamless taping"). The strips 250A and 250B of bonding tape further attach the support layer 230 to the single-panel crown 110, and cover respective seams therebetween that extend radially from a central or center portion to a bottom edge (or rim) 114 of the single-panel crown 110. The top button 112 is also attached to a central portion or center of the single-panel crown 110 with a metal snap or the like.

As further shown in FIG. 8, a visor 120, an elastic band 260 are attached to the single-panel crown 110 with the support layer 230. For example, the elastic band 260 is attached around an interior of the bottom edge 114 of the single-panel crown 110 with the attached support layer 230. The visor 120 and the elastic band 260 can be attached to the single-panel crown 110 by sewing or stitching them together to the single-panel crown 110 (see e.g., stitches or stitching 116 in FIG. 1) or separately to the single-panel crown 110.

Figure 9:
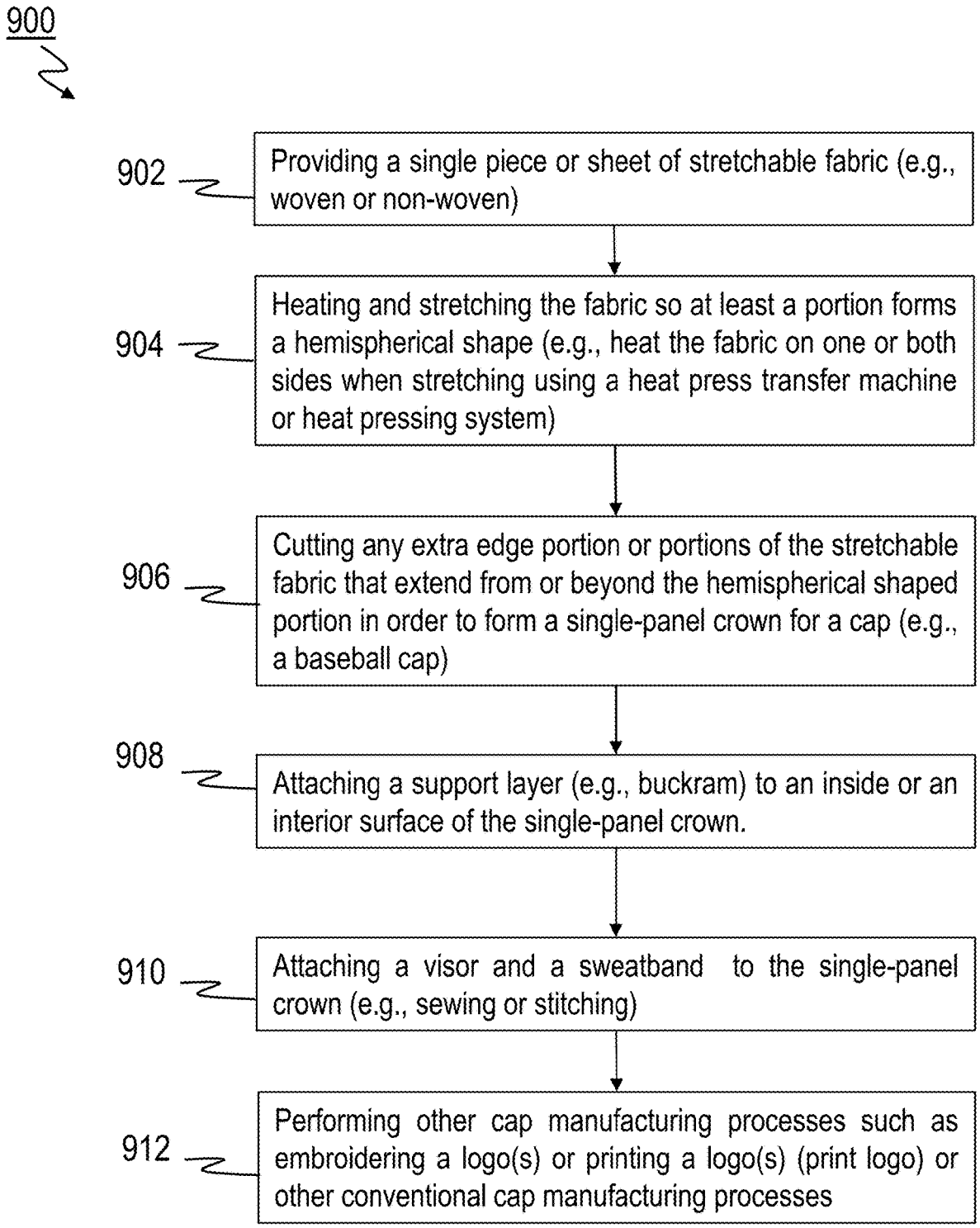
FIG. 9 is a flow diagram of an exemplary process of assembling or manufacturing headwear, such as the cap in FIG. 1.

FIG. 9 is a flow diagram of an exemplary process 900 by which a headwear, such as for example a cap as shown in FIG. 1, is assembled and manufactured with a single-panel crown. The process 900 can begin with the provision of a single sheet or single piece of stretchable fabric, at reference 902. The stretchable fabric can be made of woven or non-woven material, and can preferably be a light or lighter stretchable fabric. As previously discussed, the stretchable fabric can be an elastic fabric that incorporates spandex, such as for example between 2% to 5% of spandex or preferably around 3% of spandex.

At reference 904, the stretchable fabric is heated and stretched so at least a portion thereof forms a hemispherical shape (e.g., a dome or half-sphere shape). A hemispherical-shaped fabric mold or other suitable fabric mold of a heat press transfer machine or heat pressing system can be used to heat press, and thus, stretch the stretchable fabric into a desired shape (or dimensions). The stretchable fabric can be heated on one or both sides when stretching the fabric.

At reference 906, any extra edge portion or portions of the stretchable fabric that extend from or beyond the hemispherical-shaped portion is cut or trimmed off in order to form a single-panel crown for a cap.

At reference 908, a support layer is attached to an inside or interior surface of the single-panel crown. For baseball or similar caps, the support layer can be attached to an interior, front portion of the single-panel crown. As previously discussed, the support layer can be made of buckram, and can be formed of one or more support panels which are attached together such as by sewing or stitching, adhesive (e.g., fabric adhesive), bonding tape or a combination thereof, or by other conventional attachment techniques. For example, the support layer can initially be attached to the single-panel crown with an adhesive, and then bonding tape can be applied over the seams between outer edge or periphery of the support layer and the interior of the single-panel crown.

At reference 910, the visor and the elastic band (e.g., a sweatband) is attached to the single-panel crown, such as by sewing or stitching. The visor and the elastic band can be attached separately to the single-panel crown or attached together (e.g., at the same time or simultaneously) to the single-panel crown.

At reference 912, other cap manufacturing processes may be performed to customize the cap. For example, these and other conventional cap manufacturing processes may include embroidering a logo(s) or printing a logo(s), e.g., a print logo, on the cap.

The headwear and method of assembling thereof, which are shown and described above with reference to the figures, are simply provided as examples. It should be understood that the headwear can include a single-panel crown having a different or varying size, shape and configuration. Although the headwear in FIGS. 1 and 2 is shown as a particular type of a cap, such as a baseball cap, the single-panel crown manufacturing technique can be used to assemble or manufacture other types of caps with a visor (e.g., a bill) and having a different or varying dimensions (e.g., size and shape). In general, headwear components (including those described herein), layers of materials or accessories (e.g., lining, liners or backing for the single-panel crown, etc.) can also be attached or connected using various attachment techniques, such as sewing or stitching, adhesive (e.g., fabric adhesive), bonding tape, or a combination thereof and/or other conventional techniques for attaching components of a headwear together. Furthermore, the assembling operations can be performed in a different order, and may omit some operations or add other operations to assemble a cap with a single-panel crown.

As discussed herein, a stretchable fabric can be heated and stretched into a desired shape with a heat press transfer machine or heat pressing system that employs fabric mold. The fabric mold can include a male mold part (e.g., mold 10 in FIGS. 3 and 4) and a counterpart-female mold part, which when engaged stretches the stretchable fabric arranged therebetween into a desired shape according to the shape of the mold parts (e.g., hemispherical shape). Alternatively, the fabric mold may include only a male mold part, upon which the stretchable fabric is pressed against and stretched.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A method of assembling a cap comprising:

forming a single-panel crown for a cap from a single sheet or single piece of stretchable fabric;

attaching a support layer to an interior portion of the single-panel crown; and attaching a visor and an elastic band to the single-panel crown with the attached support layer, wherein the forming a single-panel crown comprises heating and stretching the single sheet or single piece of stretchable fabric to form a hemispherical shape on a portion of the stretchable fabric, wherein the single sheet or single piece of stretchable fabric is to be heated and stretched into the hemispherical shape without applying or adding additional materials thereto for shaping the stretchable fabric.

2. The method according to claim 1, wherein the forming a single-panel crown further comprises:

cutting any extra edge portion or portions of the stretchable fabric that extend from or beyond the hemispherical shaped portion in order to form the single-panel crown for the cap.

3. The method according to claim 1, wherein the heating and stretching comprises:

applying heat to one or both sides of the stretchable fabric; and as heat is applied, applying a pressing force with a hemispherical shaped fabric mold to stretch the portion of the stretchable fabric into the hemispherical shape.

4. The method according to claim 1, wherein the stretchable fabric comprises a woven or non-woven material.

5. The method according to claim 4, wherein the stretchable fabric includes 2% to 5% spandex.

6. The method according to claim 1, wherein the support layer comprises buckram, the attaching a support layer comprising:

applying an adhesive to a surface of the buckram or an interior, front portion of the single-panel crown; and pressing the buckram against the interior, front portion of the single-panel crown so that the adhesive bonds the buckram to the interior, front portion of the single-panel crown.

7. The method according to claim 6, further comprising:

applying bonding tape over one or more seams that are formed between an edge of the buckram and an interior surface of the single-panel crown, each of the one or more seams extending radially from an interior, central portion to a bottom edge of the single-panel crown, the bonding tape covering the one or more seams and further connecting the buckram to the single-panel crown.

8. The method according to claim 1, wherein the attaching a visor and an elastic band comprises stitching the visor and the elastic band to the single-panel crown, the elastic band attached around an interior, bottom edge of the single-panel crown.

9. The method of claim 1, wherein the cap is a baseball cap, and the elastic band is a sweatband.

10. A method of assembling a cap comprising:

forming a single-panel crown for a cap from a single sheet or single piece of stretchable fabric;

attaching a support layer to an interior portion of the single-panel crown; and attaching a visor and an elastic band to the single-panel crown with the attached support layer, wherein the single sheet or single piece of stretchable fabric comprises a fabric blank of the stretchable fabric, wherein the forming a single-panel crown comprises: heating and stretching the fabric blank of the stretchable fabric to form a single-panel crown having a hemispherical shape,.

wherein the single sheet or single piece of stretchable fabric is to be heated and stretched into the hemispherical shape without applying or adding additional materials thereto for shaping the stretchable fabric.

* * * * *